US008297335B2

(12) United States Patent
Bennett et al.

(10) Patent No.: US 8,297,335 B2
(45) Date of Patent: Oct. 30, 2012

(54) INTERCHANGEABLE WINDOW TREATMENT SYSTEM

(76) Inventors: Ann Bennett, Boynton Beach, FL (US); Manuel Ortega, Hialeah, FL (US); Tara Malanga, Boca Raton, FL (US)

( * ) Notice: Subject to any disclaimer, the term of this patent is extended or adjusted under 35 U.S.C. 154(b) by 0 days.

(21) Appl. No.: 12/657,561

(22) Filed: Jan. 19, 2010

(65) Prior Publication Data

US 2010/0181032 A1 Jul. 22, 2010

Related U.S. Application Data

(60) Provisional application No. 61/205,197, filed on Jan. 16, 2009.

(51) Int. Cl.

| | |
|---|---|
| ***A44B 1/04*** | (2006.01) |
| ***A44B 17/00*** | (2006.01) |
| ***A44B 11/00*** | (2006.01) |
| ***A44B 11/25*** | (2006.01) |

(52) U.S. Cl. ..... 160/330; 24/308

(58) Field of Classification Search ..... 160/123, 160/124, 125, 126, 330, 340, 341, 346, 347, 160/348, 349; 16/87.2, 87 R, 87.8, 94 D, 16/96 D See application file for complete search history.

(56) References Cited

U.S. PATENT DOCUMENTS

| | | | | |
|---|---|---|---|---|
| 5,517,722 | A * | 5/1996 | Bender | 16/87.2 |
| 5,903,957 | A * | 5/1999 | Le Manchec | 16/87.2 |
| 2003/0131405 | A1 * | 7/2003 | Greaves | 4/558 |

* cited by examiner

*Primary Examiner* — Katherine W Mitchell
*Assistant Examiner* — Jeremy Ramsey
(74) *Attorney, Agent, or Firm* — Robert M. Downey, P.A.

(57) ABSTRACT

An interchangeable window treatment system has a plurality of independent fabric components including, but not limited to, a base drape panel, a valance, strap members and at least one overlay drape panel. The strap members are positioned at spaced intervals along a top of the base drape panel, forming loops to support the window treatment system on a horizontal rod. In one embodiment, the valance, one or more overlay panels and strap members are removably secured to the base drape panel with dumbbell shaped button links having enlarged button heads on opposite ends that fit through openings in the fabric (eyelets, buttonholes, etc.) on each of the attached fabric components. Any of the fabric components can be removed, reversed, interchanged and replaced to change the overall appearance of the window treatment system according to a desired style, color scheme, or theme. Medallions or other decorative elements are removably attachable at spaced intervals along the valance, button links or strap members. In another embodiment, the straps and valance are sewn to the base panel, as one piece, and the overlay drape panels and decorative elements are attached by snaps, magnets or other releasable fastening devices.

10 Claims, 7 Drawing Sheets

INTERCHANGEABLE WINDOW TREATMENT SYSTEM

This non-provisional patent application is based on previously filed provisional patent application Ser. No. 61/205,197 filed on Jan. 16, 2009.

BACKGROUND OF THE INVENTION

1. Field of the Invention

The present invention relates to window treatments and, more particularly, to an interchangeable drape system that allows for easy and convenient removal, reversal, interchanging and replacement of drapes, valances and decorative elements to change the overall appearance of a window treatment.

2. Discussion of the Related Art

Existing drape designs for windows typically use one or more drape panels made of a fabric material. The color, texture and pattern of the drape fabric is usually selected to complement the interior design of a room. The drape panels are hung on a horizontal rod or sliding track system above the top of a window and serve the purpose of dressing the window, while also blocking entry of light when drawn closed. A valance is often installed along a top of the drapes to hide unsightly hardware and to further dress the window. Ideally, it may be desirable to change the color and patterns of drapes according to the changing seasons, holidays, special occasions or simply to provide a fresh new design. However, current methods of drape installation make it very difficult and time consuming to interchange drape fabrics. Moreover, the cost to purchase and install drapes is considerably expensive. For these reasons, it is not practical or affordable for most homeowners and consumers to change their drapes on a periodic basis.

Accordingly, there remains a definite need for a window drape system that allows for easy attachment, removal, and interchanging of a base drape panel, a valance and supporting straps in order to selectively change and customize the overall appearance of a window treatment according to the desires of the user.

3. Objects and Advantages of the Invention

Considering the foregoing, it is a primary object of the present invention to provide an interchangeable window treatment system that allows for easy and convenient removal, replacement and interchanging of a base drape panel, a valance, and a plurality of supporting straps in order to selectively change the overall appearance of a window treatment according to a desired style, color scheme, and/or decorative theme.

It is a further object of the present invention to provide an interchangeable window treatment system, as described above and further including decorative elements such as medallions, teddy bears, hearts, sports balls, and the like, for removable attachment to the interchangeable window treatment system.

It is yet a further object of the present invention to provide an interchangeable window treatment system that has reversible components, including a base drape panel, a valence and supporting straps, to thereby allow for a variety of customized color schemes according to the user's personal taste.

It is still a further object of the present invention to provide an interchangeable window treatment system, as described above, which is easy to install and operate.

It is still a further object of the present invention to provide an interchangeable window treatment system, as described above, which is affordable to the average consumer.

These and other objects and advantages of the present invention are more readily apparent with reference to the following detailed description and accompanying illustrations.

BRIEF DESCRIPTION OF THE DRAWINGS

For a fuller understanding of the present invention, reference should be made to the following detailed description taken in conjunction with the accompanying illustrations in which.

DETAILED DESCRIPTION OF THE INVENTION

Figure 1:
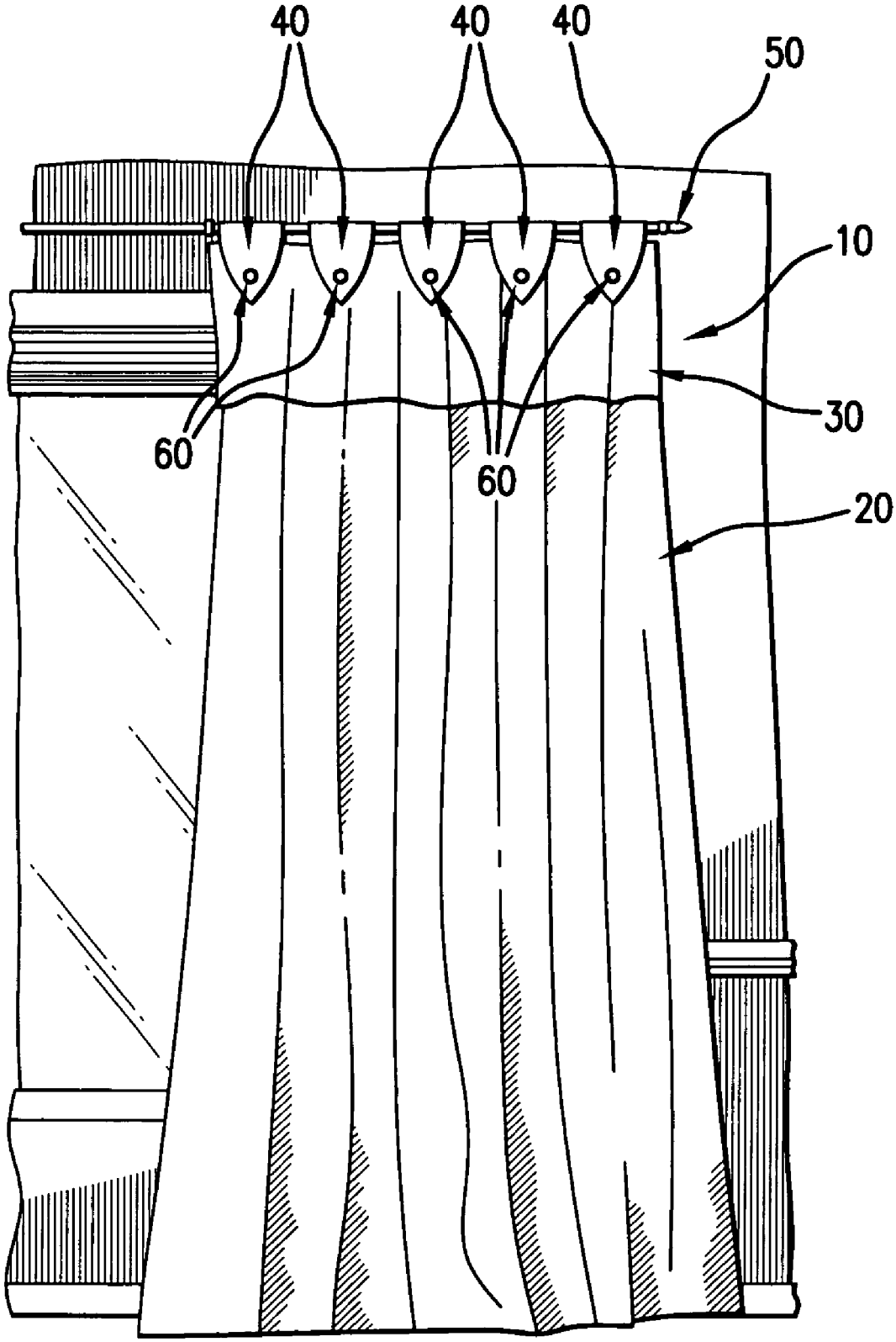
FIG. 1 is a front elevational view showing a base drape panel and valance installed on a horizontal drape rod in accordance with the present invention.
Figure 2:
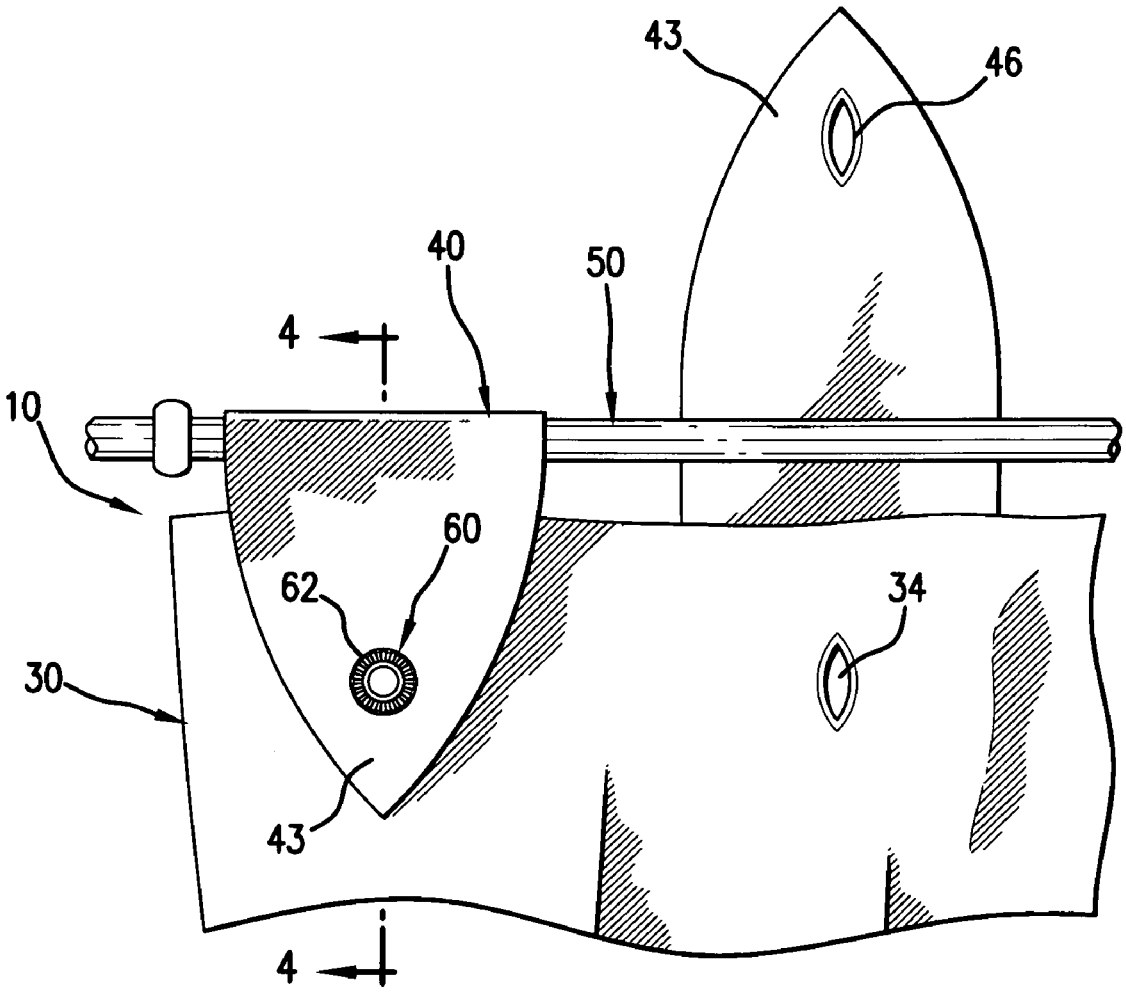
FIG. 2 is an isolated elevational view showing a button link securing a strap member to a valance and a base drape panel and a second strap member being extended over the horizontal drape rod during assembly to form a loop for hanging the window treatment system on the horizontal drape rod.
Figure 3:
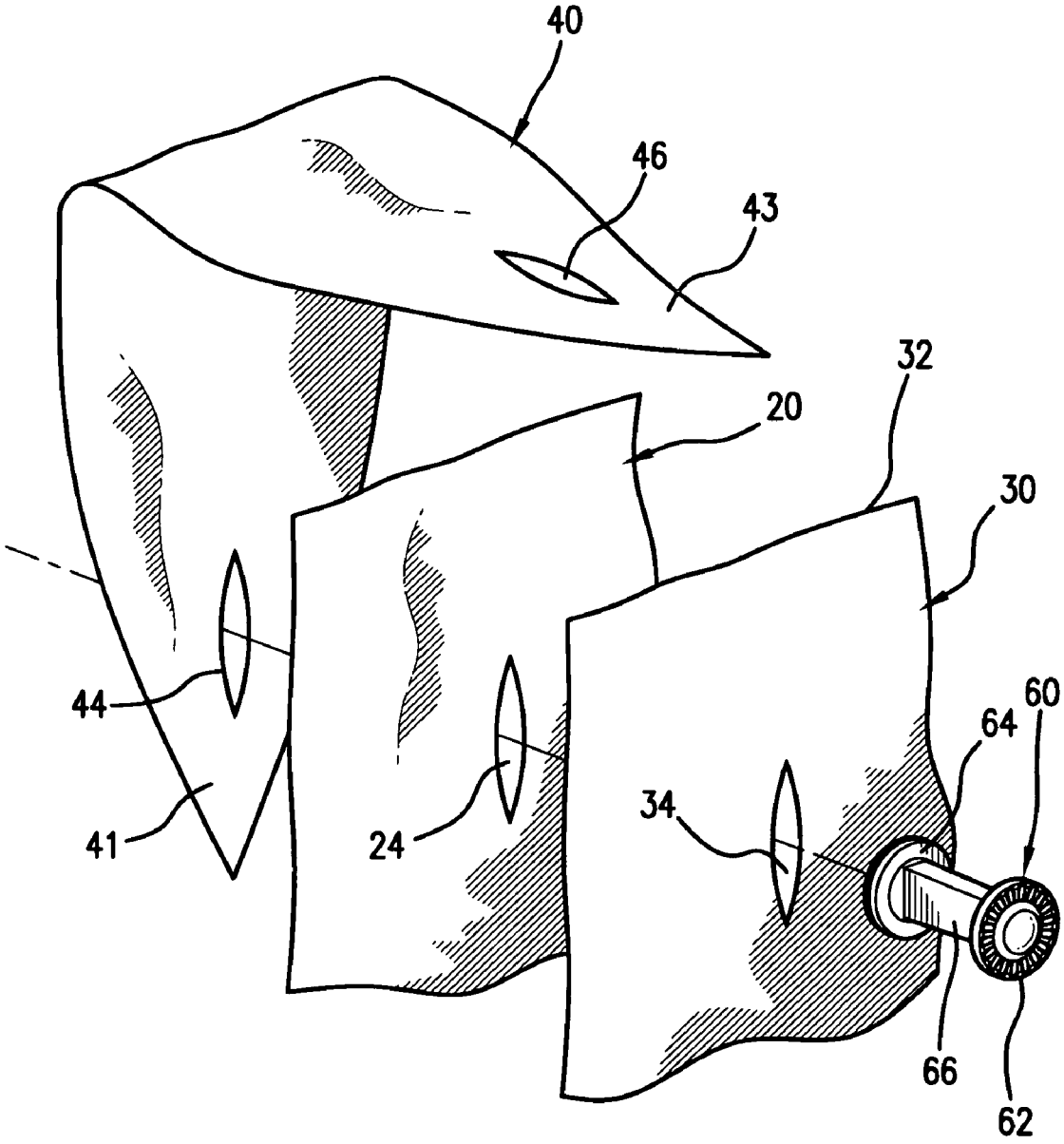
FIG. 3 is an isolated exploded perspective view showing the strap member being secured to the valance and base drape panel with the use of the button link which also forms the loop over the horizontal drape rod.
Figure 4:
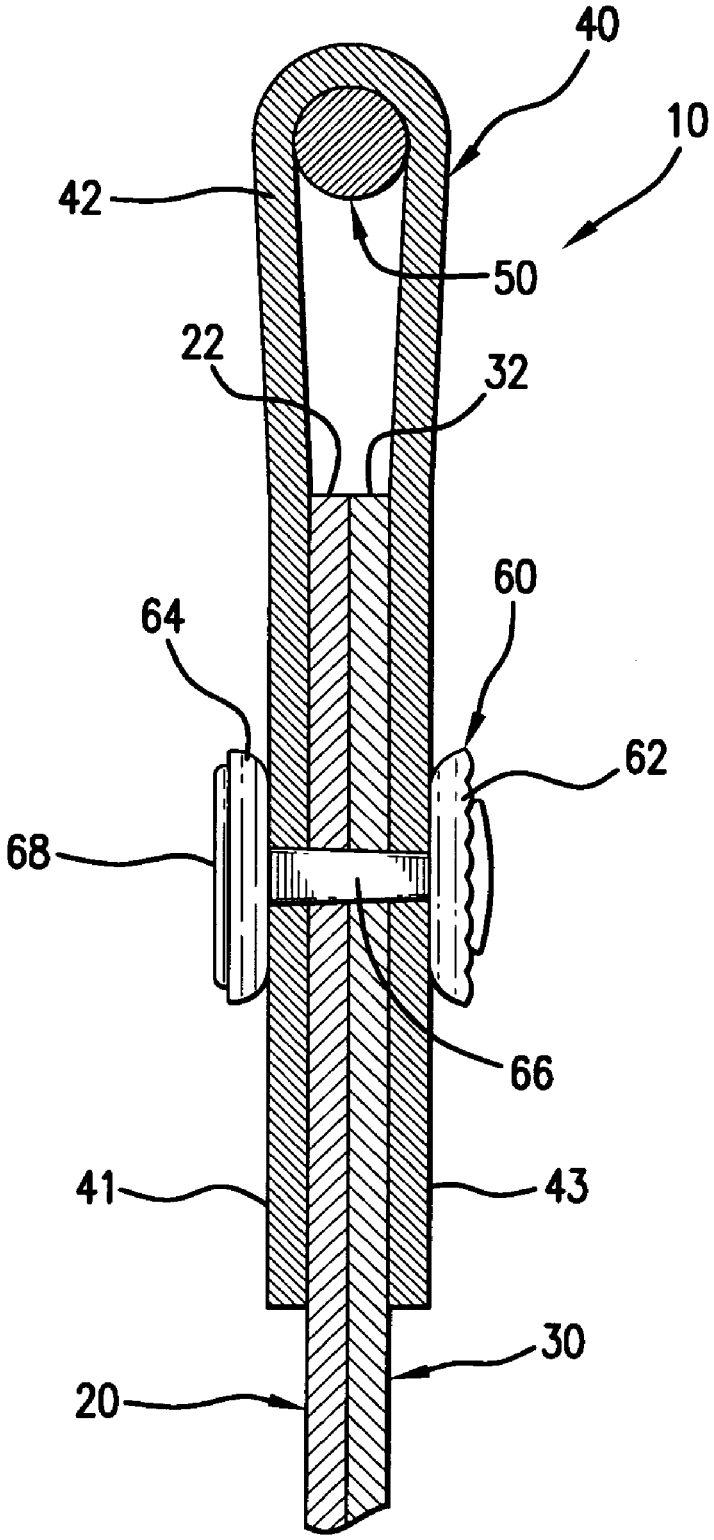
FIG. 4 is an isolated cross sectional view taken along the plane indicated as 4-4 in FIG. 2 showing attachment of the strap member to the base drape panel and valance and looped over the drapery rod with the use of the button link.
Figure 5:
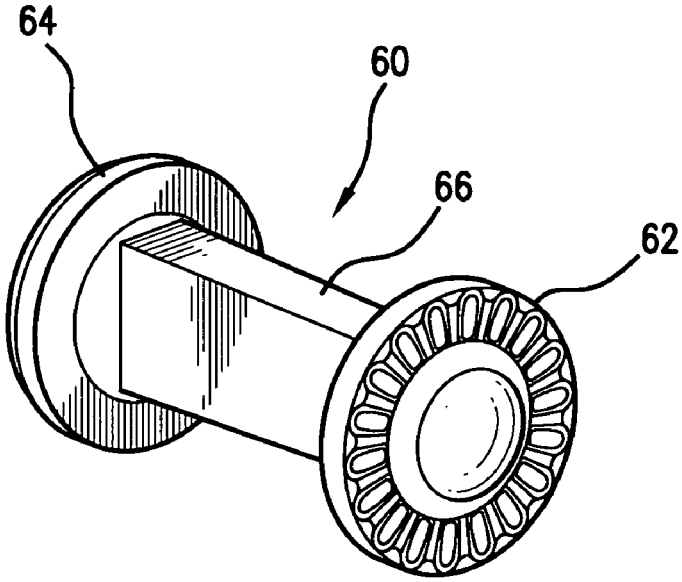
FIG. 5 is an isolated perspective view of a button link used for attaching the plurality of fabric components of the interchangeable window treatment system, in accordance with one preferred embodiment of the invention.
Figure 6:
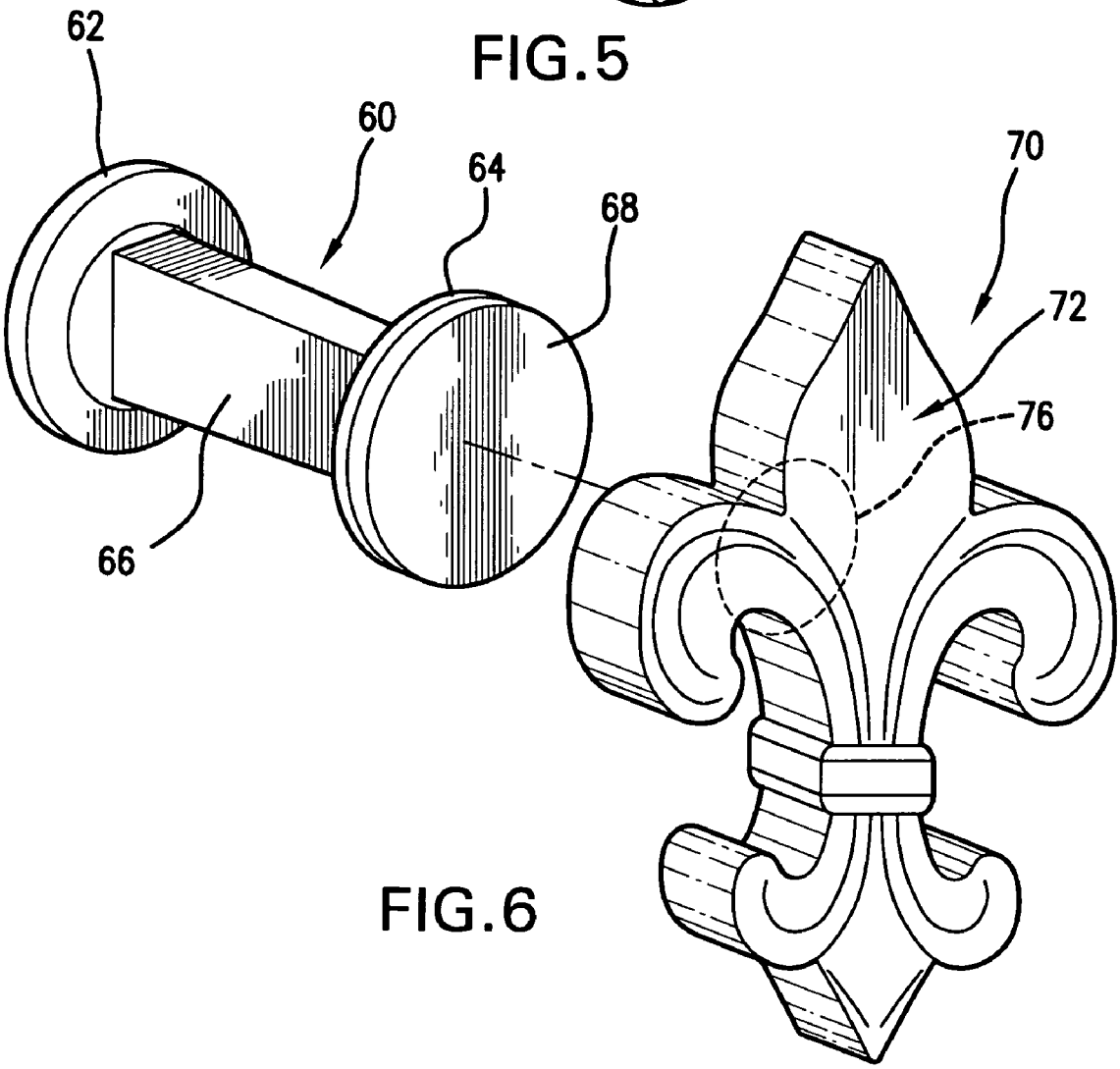
FIG. 6 is an exploded perspective view showing magnetic, releasable attachment of a medallion to the head of the button link.

The present invention is directed to an interchangeable window treatment system 10 that allows for easy and convenient change of the overall appearance of the window treatment according to a desired style, pattern, color scheme or design theme. The interchangeable window treatment system 10 has a plurality of fabric components including a base drape panel 20, a valance 30, and a plurality of strap members 40. The system may further include at least one secondary or overlay drape panel. The plurality of strap members 40 are positioned at spaced intervals along the top of the base drape panel 20 and form loops 42 for hanging the base drape panel 20 on a horizontal drapery rod 50. In a preferred embodiment, the base drape panel 20, the valence 30 and the plurality of strap members 40 each have one fabric color on a first side and a different fabric color on an opposite side. This allows the user to use one color for all components or, alternatively, to mix and contrast colors of the different fabric components to achieve a customized look and design. The strap members 40, valance 30 and one or more overlay panels may be attached to the base panel 20 with the use of a plurality of dumbbell shaped button links 60. Each button link 60 has enlarged button heads 62, 64 on opposite ends and a rigid stem or flat web 66 that extends between the enlarged button heads. One of the enlarged button heads is fitted through eyelets on each of the attached fabric components to secure the plurality of fabric components together. The strap members 40 are fastened to the opposite button heads 62, 64, on opposite sides of the base drape panel 20, forming the loop 42 that extends over the horizontal drapery rod 50. The overlay panels (not shown) may include any of a variety of patterns, colors, and fabrics, including sheer fabrics, and may be attached in layers to either or both sides of the base drape panel 20. Use of the button links 60 allows the strap members 40, valance 30 and one or more overlay panels (if used) to be reversed in order to reveal a different color, pattern, or fabric on the opposite side. Alternatively, any of the various fabric components, including the valance 30, the strap members 40, and overlay panels may be covered by, removed and/or replaced with a different fabric component according to a desired style, color, fabric, pattern or decorative theme.

The interchangeable window treatment system 10 further includes any of a variety of decorative elements 70 (e.g., medallions, teddy bears, hearts, ornamental shapes, sports balls, etc.) that are removably attachable at spaced intervals along the valance. The medallions 72 or other decorative elements are attached to one of the enlarged button heads of the button links 60. This may be achieved by either fitting the enlarged button heads within a slot on the back of the decorative elements or, alternatively, with the use of magnets, snaps, hook and loop fasteners, or other releasable fasteners. In a preferred embodiment of the invention, the button links 60 have a first button head 62 with an ornamental design and an opposite second button head 64 that has a metal (magnet or magnetically attractive) disc 68 for selectively and removably attaching any of a vast variety of ornamental medallions or other decorative elements.

The method of assembly and installation of the interchangeable window treatment system 10 is now described. To begin, the base drape panel 20 is unfolded and spread out flat on a table or other suitable work surface with the color desired by the user facing up. All of the button holes 24 along the top portion of the base drape panel 20 should be clearly exposed on the work surface and spread apart. Next, the valance 30 is unfolded and the side is selected according to the color desired by the user facing up. The user may choose to match the valance color with the base drape panel or, alternatively, to reverse the valance to provide a beautiful contrasting look. The valance 30 is then placed on top of the base drape panel 20, with the desired colors of both the base drape panel and the valance facing up and the top edge 32 of the valance substantially aligned with the top edge 22 of the base drape panel 20 so that the arrangement of button holes 24 in the base drape panel aligns with the arrangement of button holes 34 in the valance 30. Next, the user chooses a strap member design and the desired color and pattern for the strap members 40. The user may desire to use the same color for all strap members 40 or to alternate colors between the strap members. For example, the user may keep the strap members 40 and the valance 30 all the same color in contrast with the base drape panel 20. Alternatively, the user may choose to have the same colors for the base drape panel 20 and each of the strap members 40 while contrasting with the color of the valance 30. The reversible color features of each of the fabric components allows the user to be creative and to personalize their one-of-a-kind look and design. Next, the plurality of strap members 40 are fastened to the base drape panel 20 and valance 30 by folding each strap member 40 in half, and laying each strap member 40 over the top of the base drape panel/valance combination, with one end 41 of the strap member 40 behind the base drape panel 20 and the other end 43 laying in front of the valance 30 on the front, while aligning the button holes 44, 46 on both ends of the strap member 40 with the already aligned button holes 24, 34 in the base drape panel and valance. At this point, the user can place the drapery rod 50 above the strap members 40 and assemble the system directly on the drapery rod if they choose to or, alternatively, the user may feed the rod 50 through the loops 42 formed by the strap members after complete assembly of the system.

To complete attachment of the strap members 40 to the valance 30 and base drape panel 20, pick up one of the reversible button links 60 and choose which head of the button link the user desires to be displayed. If the user desires to choose the smaller traditional head 62 having an ornamental appearance, they will not need to use the decorative medallions 72 or other decorative elements 70 that magnetically attach to the button links. Alternatively, if the user wishes to use any of a variety of ornamental medallions 72 or other decorative elements, the button links 60 are picked up with the magnetically attractive elements 68 facing towards the user. Next, all layers of the base drape panel 20, the valance 30 and folded strap member 40 combination are picked up and flipped over. Next, the desired one of the two button heads is guided through the aligned button holes in each of the layers of the combined strap member, base drape panel and valance, beginning on the back side of the assembly, until the enlarged button head emerges from the button hole 46 in the outer facing side of the strap member 40. This assembly, using the button links 60, is repeated at each location where the strap members 40 are secured to the combined base drape panel 20 and valance 30.

If the user did not assemble the drapes directly onto a drapery rod 50 when attaching the strap members 40, the drapery rod can now be fed through the loops 42 formed by the strap members. The assembly is now ready to hang at the desired location above a window or door. Once the drape system 10 is hung and the base drape panel 20 and valance 30 are adjusted to satisfaction, the ornamental medallions 72 can be attached by placing each medallion 72 over the magnetic attractively element 68 on each exposed button head 64 and, with the magnet 76 on the rear of the medallion 72 aligned with the magnetically attractive element 68, the medallion 72 is clicked into place to effectively attach the medallion 72 to the button head. 64 In the event the user has chosen to attach ornamental medallions or other decorative elements, the user can easily interchange the medallions or other decorative elements while the assembly remains hung from the drapery rod.

Figure 7:
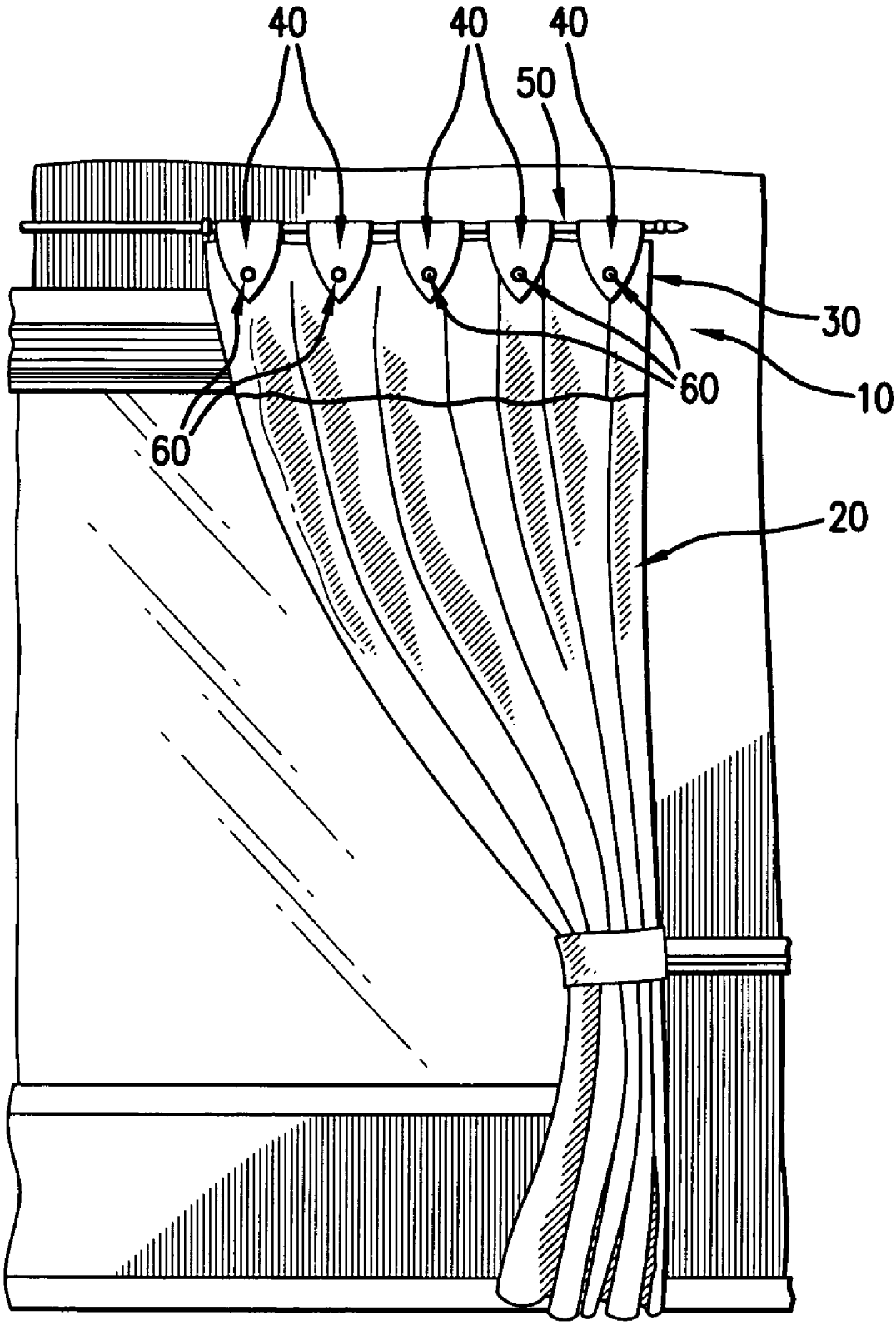
FIG. 7 is a front elevational view showing the interchangeable window treatment system of the invention fully assembled and installed with a tie-back band.
Figure 8:
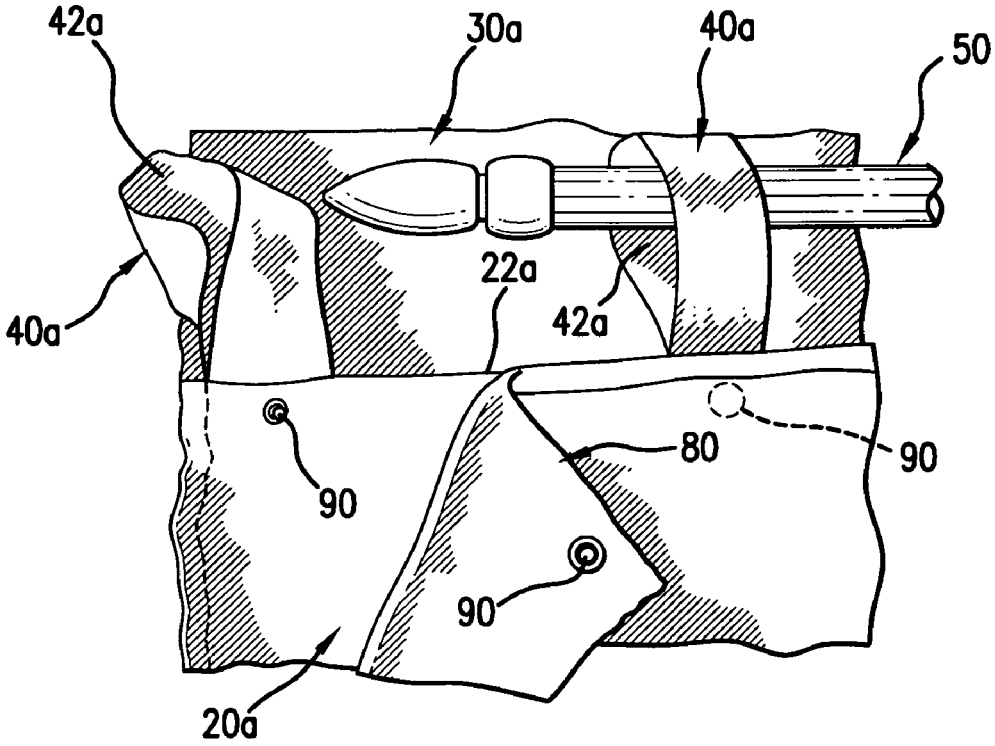
FIG. 8 is an isolated front perspective view of a second embodiment of the invention showing an overlay panel being secured to a rear side of the base drape panel with the use of snap fasteners, and wherein the looped straps for hanging the base drape panel and the valance are sewn to the base drape panel in accordance with the second preferred embodiment of the invention.
Figure 9:
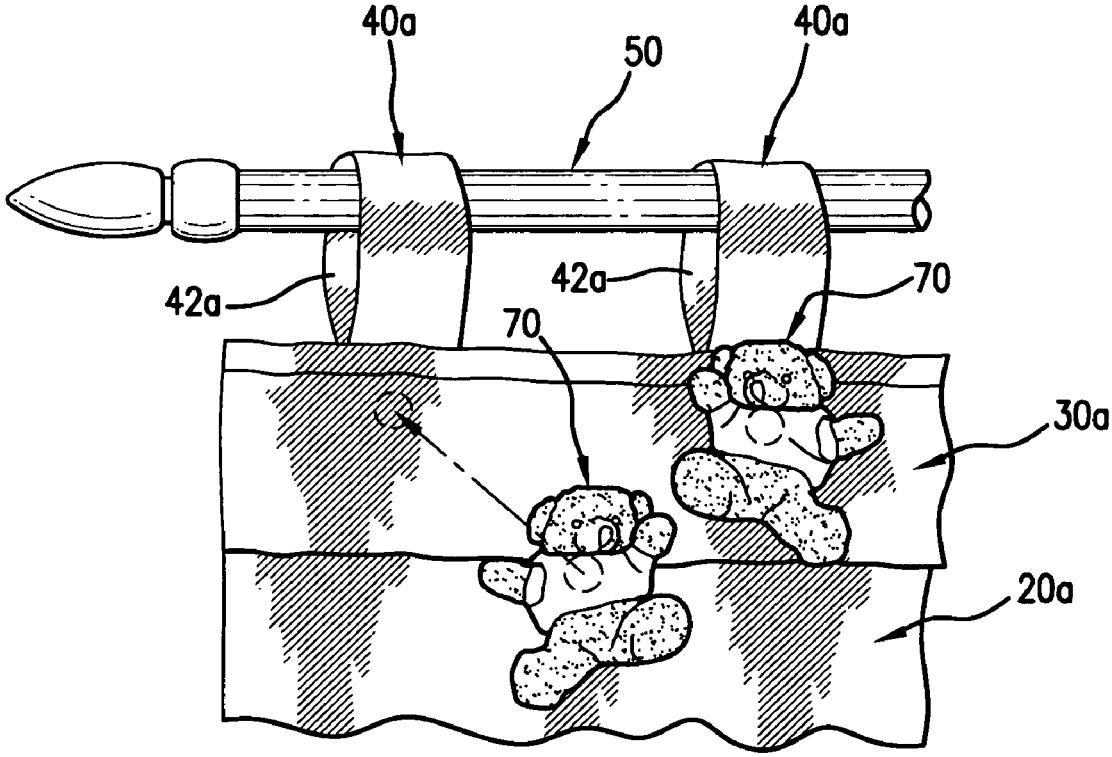
FIG. 9 is an isolated front elevational view showing teddy bears secured to the valance using snap fasteners, magnets for hook and loop releasable fasteners in accordance with the second preferred embodiment of the invention.

FIGS. 7-9 illustrate an alternative embodiment of the invention which provides for snap fasteners 90 for attaching the one or more overlay panels 80 on either or both sides of the base drape panel 20*a*. In this second embodiment, the strap members 40*a* are permanently sewn to the base drape panel 20*a* and are formed in the loop 42*a* for hanging the base drape panel 20*a* on the horizontal drape rod 50. Additionally, the valance 30*a* is permanently sewn to the top edge 22*a* of the base drape panel and folds over to conceal the snap fasteners 90 or other releasable fasteners on the top of the base drape panel 20*a* and the attached overlay panels 80. The various decorative elements 70 are attached to the outer side of the valance, at spaced intervals, with the use of snap fasteners, magnets, hook and loop fasteners or other releasable fasteners. FIG. 9 shows an example of the invention wherein teddy bears are releasably attached to the valance at spaced intervals.

It is noted that the interchangeable window treatment system of the present invention contemplates use of any available and practical releasable fastener for removably attaching the plurality of fabric components (i.e., the valance, strap members, one or more overlay drape panels) to the base drape panel, as well as the various decorative elements to the valance, base drape panel or other fabric components. Examples of suitable releasable fasteners include, but are not limited to, magnets, magnet and metal mating components, hooks, eyelets, button links and corresponding eyelets, hook and loop fasteners, and snap fasteners.

While the present invention has been shown and described in accordance with several preferred and practical embodiments, it is recognized that departures from the instant disclosure are fully contemplated within the spirit and scope of the present invention.

What is claimed is:

1. An interchangeable window treatment system comprising:

a front face and a rear face;

a base drape panel formed of at least one fabric material and including a first side and an opposite second side, said base drape panel having an overall height defined by a distance between a top edge and a bottom edge, and an overall width defined by a distance between a left vertical edge and a right vertical edge, and said base drape panel further having an arrangement of button holes formed therethrough and communicating between the first and second sides, and said arrangement of button holes extending across the overall width of said base drape panel at spaced intervals below said top edge and said base drape panel being independently and selectively reversible so that either said first side or said second side is positioned on the front face and the other of said first and second sides is positioned on the rear face;

a valance formed of at least one fabric material and including a first side and an opposite second side, and said valance having a height measured between a top edge and a bottom edge, and a length measured between a left vertical edge and a right vertical edge, and said height of said valance being less than the overall height of said base drape panel, and said valance further having an arrangement of button holes formed therethrough and communicating between the first and second sides thereof, and said arrangement of button holes in said valance being sized, spaced and positioned for alignment with the arrangement of button holes in said base drape panel when said top edge of said valance is aligned with the top edge of said base drape panel and said left and right vertical edges of said valance are correspondingly aligned with said left and right vertical of said base drape panel, and said valance being independently and selectively reversible to visibly expose either said first side or said second opposite side;

a plurality of support strap members and including a first side and an opposite second side and each including a first button hole and a second button hole, and each of said strap members being adapted to be formed in a loop by folding said strap member in half so that said first button hole aligns with said second button hole, and each of said strap members being further structured and disposed to be positioned at spaced intervals along a top of said base drape panel and said valance so that said first button hole of each strap member aligns with a button hole on said base drape panel and said second button hole on said strap member aligns with a correspondingly aligned button hole in said valance, and each of said plurality of support strap members being independently and selectively reversible to visibly expose either said first side or said opposite second side relative to said base drape panel and said valance;

a plurality of button links each having a pair of oppositely disposed enlarged heads, including a first enlarged head, a second enlarged head, and a web extending and connecting between said first and second enlarged heads, and either of said first and second enlarged heads being structured and disposed for passage through the aligned button holes in said base drape panel and said valance and the first and second button holes in one of said strap members to thereby secure said base drape panel, said valance and the one of said strap members together with the one of said strap members formed in a loop that extends above the top edges of said base drape panel and of said valance, and the loop formed by each of said plurality of strap members being structured and disposed for passage of a horizontal drapery support rod therethrough to thereby hang the window treatment system, said first enlarged head of said button links being provided with an ornamental appearance, and said second enlarged head of said button links includes a magnetically attractive element thereon, and each of said plurality of button links being selectively reversible in relation to said first and second sides of said base drape panel and said valance to visibly expose either said first enlarged head or said second enlarged head on said front face;

a plurality of medallions, each of said medallions having an ornamental front face, a rear face, and a magnet on the rear face for removable attachment to the magnetically attractive element on the button links, and wherein the plurality of button links can each be selectively fitted to said base drape panel, said valance, and said strap member to selectively position either said first enlarged head or said second enlarged head on said front face of the interchangeable window treatment system; and whereby each of said base drape panel, said valance, said plurality of support strap members, and said plurality of button links may be removed, reversed and interchanged for changing the overall appearance of said interchangeable window treatment system.

2. The interchangeable window treatment system as recited in claim 1 wherein the first and second sides of said base drape panel are different in color.

3. The interchangeable window treatment system as recited in claim 2 wherein the first and second sides of said valance are different in color.

4. The interchangeable window treatment system as recited in claim 3 wherein the first and second sides of each of said plurality of strap members are different in color.

5. An interchangeable window treatment system comprising:

a front face and a rear face;

a base drape panel formed of at least one fabric material and including a first side and an opposite second side, said base drape panel having an arrangement of button holes extending across said base drape panel at spaced intervals below a top edge of said base drape panel, and said base drape panel being independently and selectively reversible so that either said first side or said second side is positioned on the front face and the other of said first and second sides is positioned on the rear face;

a valance formed of at least one fabric material and including a first side and an opposite second side, said valance having an arrangement of button holes sized, spaced and positioned for alignment with the arrangement of button holes in said base drape panel, and said valance being independently and selectively reversible to visibly expose either said first side or said opposite second side;

a plurality of support strap members and including a first side and an opposite second side and each including a first button hole and a second button hole, and each of said strap members being adapted to be formed in a loop by folding said strap member in half so that said first button hole aligns with said second button hole, and each of said strap members being further structured and disposed to be positioned at spaced intervals along a top of said base drape panel and said valance so that said first button hole of each strap member aligns with a button hole on said base drape panel and said second button hole on said strap member aligns with a correspondingly aligned button hole in said valance, and each of said plurality of support strap members being independently and selectively reversible to visibly expose either said first side or said opposite second side relative to said base drape panel and said valance;

a plurality of button links each including a pair of oppositely disposed button heads, including a first button head, a second button head, and a web extending and connecting between said first and second button heads, and either of said first and second button heads being structured and disposed for passage through the aligned button holes in said base drape panel, said valance, and the first and second button holes in one of said strap members to thereby secure said base drape panel, said valance and the one of said strap members together with the one of said strap members formed in a loop for passage of a horizontal drapery support rod therethrough to thereby hang the window treatment system, said first button head being provided with an ornamental appearance, and said second button head includes a magnetically attractive element thereon, and each of said plurality of button links being selectively reversible in relation to said first and second sides of said base drape panel and said valance to visibly expose either said first enlarged head or said second enlarged head on said front face;

a plurality of medallions, each of said medallions having an ornamental front face, a rear face, and a magnet on the rear face for removable attachment to the magnetically attractive element on the button links, and wherein the plurality of button links can each be selectively fitted to said base drape panel, said valance, and said strap member to selectively position either said first enlarged head or said second enlarged head on said front face of the interchangeable window treatment system; and whereby each of said base drape panel, said valance, said plurality of support strap members, and said plurality of button links may be individually and independently removed, reversed and interchanged for changing the overall appearance of said interchangeable window treatment system.

6. The interchangeable window treatment system as recited in claim 5 wherein said base drape panel includes a first side and an opposite second side, and said first and second sides having a different color.

7. The interchangeable window treatment system as recited in claim 6 wherein said valance includes a first side and an opposite second side and said first and second sides having a different color.

8. The interchangeable window treatment system as recited in claim 7 wherein each of said plurality of strap members include a first side and a second side, and said first and second sides having a different color.

9. The interchangeable window treatment system as recited in claim 1 further comprising:

a secondary overlay drape panel formed of at least one fabric material and including a first side and an opposite second side, said secondary overlay drape panel having an overall height defined by a distance between a top edge and a bottom edge, and an overall width defined by a distance between a left vertical edge and a right vertical edge, and said secondary overlay drape panel further having an arrangement of button holes formed therethrough and communicating between the first and second sides, and said arrangement of button holes extending across the overall width of said secondary overlay drape panel at spaced intervals below said top edge.

10. The interchangeable window treatment system as recited in claim 5 further comprising:

a secondary overlay drape panel formed of at least one fabric material and including a first side and an opposite second side, said secondary overlay drape panel having an overall height defined by a distance between a top edge and a bottom edge, and an overall width defined by a distance between a left vertical edge and a right vertical edge, and said secondary overlay drape panel further having an arrangement of button holes formed therethrough and communicating between the first and second sides, and said arrangement of button holes extending across the overall width of said secondary overlay drape panel at spaced intervals below said top edge.

* * * * *